US006530416B1

(12) United States Patent
Tiemann

(10) Patent No.: US 6,530,416 B1
(45) Date of Patent: Mar. 11, 2003

(54) METHOD AND DEVICE FOR PRODUCING A METALLIC HOLLOW BODY

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/700,501

(22) PCT Filed: Mar. 5, 1999

(86) PCT No.: PCT/DE99/01289

§ 371 (c)(1),
(2), (4) Date: Apr. 12, 2001

(87) PCT Pub. No.: WO99/59748

PCT Pub. Date: Nov. 25, 1999

(30) Foreign Application Priority Data

May 14, 1998 (DE) ..... 198 21 770

(51) Int. Cl.[7] ..... B22D 33/04

(52) U.S. Cl. ..... 164/137; 164/122.1; 164/397; 164/340

(58) Field of Search ..... 164/370, 369, 164/397, 398, 399, 341, 340, 137, 35

(56) References Cited

U.S. PATENT DOCUMENTS 3,662,816 A * 5/1972 Bishop et al. ..... 164/366
3,965,963 A * 6/1976 Phipps et al. ..... 164/22.1
4,416,321 A * 11/1983 Goddard et al. ..... 164/122.1
4,487,246 A * 12/1984 Frasier ..... 164/122.2
4,596,281 A * 6/1986 Bishop ..... 164/122.1
4,811,778 A * 3/1989 Allen et al. ..... 164/35
5,820,774 A * 10/1998 Dietrich ..... 164/369
5,950,705 A * 9/1999 Huang ..... 164/122.1

FOREIGN PATENT DOCUMENTS

DE 3312867 A1 11/1983
DE 3823287 A1 1/1990
GB 2 150 875 A * 7/1985

* cited by examiner

*Primary Examiner*—M. Alexandra Elve
*Assistant Examiner*—Kevin L McHenry
(74) *Attorney, Agent, or Firm*—Eckert Seamans Cherin & Mellott, LLC

(57) ABSTRACT

The invention relates to a device for manufacturing a metallic hollow body (1) having at least one hollow space (3, 5, 17) and a wall encompassing the hollow space, comprising an exterior casting mold which has at least one inside core (33, 35, 47) serving to form the hollow space. The exterior casting mold is separable into at least two exterior members (29A, 29B) and the inside core (33, 35, 47) is connected via at least one connecting element (53), which serves to form a through-opening (25) in the wall (23) into the hollow space (3, 5, 7), with an exterior member (29A, 29B) of the exterior casting mold.

13 Claims, 3 Drawing Sheets

METHOD AND DEVICE FOR PRODUCING A METALLIC HOLLOW BODY

BACKGROUND

1. Field of the Invention

The invention relates to a method and a device for manufacturing a metallic hollow body having at least one hollow space, particularly a turbine blade having a cooling air channel and multiple cooling air openings.

2. Related Art

Various methods are known in the art for manufacturing metallic hollow bodies comprising a hollow space where the casting methods play a special role. Casting methods permit the production of precise, fully dimensioned components where the component is substantially shaped in one step, during the casting process, and merely some processing steps for fine machining may possibly be required. Consequently, such casting methods are particularly suitable for manufacturing turbine blades, particularly gas turbine blades. In order to be able to consistently withstand the high temperatures in operation turbine blades are metallic hollow bodies, for example, whose hollow space is designed as a cooling air channel which can be acted upon with cooling air. Turbine blades with a so-called film cooling additionally have cooling air openings on their outside surface leading into the cooling air channel and forming a cooling air film on the outside surface of the turbine blade for the purpose of cooling.

DE 38 23 287 C2 specifies a casting method where a core forming the hollow space is encompassed by a wax jacket. The thickness of the wax jacket corresponds to the thickness of the wall of the component to be cast. Pins are inserted into the wax jacket whose inside ends touch the core while the outside ends of the pins project above the wax jacket. The wax jacket with the pins is then dipped into a ceramic paste, encompassed by the latter and subsequently heated so as to allow the ceramic paste to harden and form a ceramic exterior casting mold. During the heating process the wax jacket melts while the core held by the pins remains fixed in its position. The hardened ceramic paste with the core, which is usually also ceramic, forms the casting mold which is subsequently filled with molten metal. The material of the pins, for example platinum, can be melted on by means of the molten metal and diffuse into the metal. The material for the pins is selected such that substantially no localized, harmful alloys will develop. In order to prevent flaws from developing while the metal component solidifies, which may occur as a result of heat loss on the pins projecting into the exterior casting mold, for example, the pins are provided with heat retaining caps that help prevent rapid heat loss on the pins. Cooling air openings leading into the hollow space are subsequently drilled through the exterior wall for producing a film-cooled turbine blade.

One disadvantage of the above method is that the pins extend so far into the exterior casting mold that the ends of the pins will project above the surface of the completed component which requires the component to be reworked. Furthermore, the pins cannot have any desired width for fixing the core in its position because undesirable localized alloys could develop. In addition, the number of pins of platinum for fixating the core has to be limited for cost reasons.

In order to prevent that a finished component has to be reworked, DE 33 12 867 A1 specifies a method where the core forming the hollow space is encompassed by a support whose external shape will not project above the surface of the component to be cast. The core, including the support, is subsequently encompassed by a wax jacket and dipped into a ceramic paste. In this case, the support for the core consists of a material which dissolves in the cast alloy and will not negatively affect the properties of the component.

Again, there is the disadvantage of having to drill cooling air openings into the wall of the turbine blade by means of an additional process step.

Furthermore, the disadvantage of both methods is that already when the wax jacket is removed, the varying thermal expansion behavior of the pins or the support and the core could cause the core to shift relative to the future exterior wall which will result in a fluctuating wall thickness.

It has been found that a casting mold which was produced with the aid of a wax-jacketed core already has deviations in the hollow space with regard to the desired wall thickness of the component to be cast when it is released by the wax. The deviations in the position of the core with regard to its desried position are the result, among other things, of the varying thermal expansion of the ceramic core, the metallic pins or supports and the wax forming the wax jacket.

Further deviations can occur when the hollow space formed by the casting mold is filled with molten metal and during the subsequent solidifying of the metal. The varying thermal effect on the core and the pins or supports of the casting mold can result in a varying thermal expansion, which, under adverse conditions, can cause the core to warp and thus result in a further localized variation in the wall thickness.

It is the object of the invention to provide a method for manufacturing a metallic hollow body It is also the object of the invention to provide a device for manufacturing a metallic hollow body, particularly a turbine blade for a gas turbine.

SUMMARY OF THE INVENTION

The problem of finding a device is solved in accordance with the invention by means of a device for manufacturing a metallic hollow body having at least one hollow space and a wall encompassing the hollow space, comprising an exterior casting mold which has at least one inside core serving to form the hollow space, where the exterior casting mold is separable into at least two exterior members and the inside core is connected via at least one connecting element, which serves to form a through-opening in the wall into the hollow space, with an exterior member of the exterior casting mold.

BRIEF DESCRIPTION OF THE DRAWINGS

The device and the method for producing a hollow body will be explained in more detail by means of the exemplary embodiments shown in the drawing. The figures show the following in schematic representation.

The elements having the same function have the same reference numbers in all figures. The invention is based on the idea of producing the casting mold without a lost wax jacket and improving the fastening of the core on the rest of the casting mold so as to prevent any relative movements of the core relative to the remaining casting mold which could result in an undesired change in the wall thickness.

DESCRIPTION OF THE PREFERRED EMBODIMENT

Figure 3:
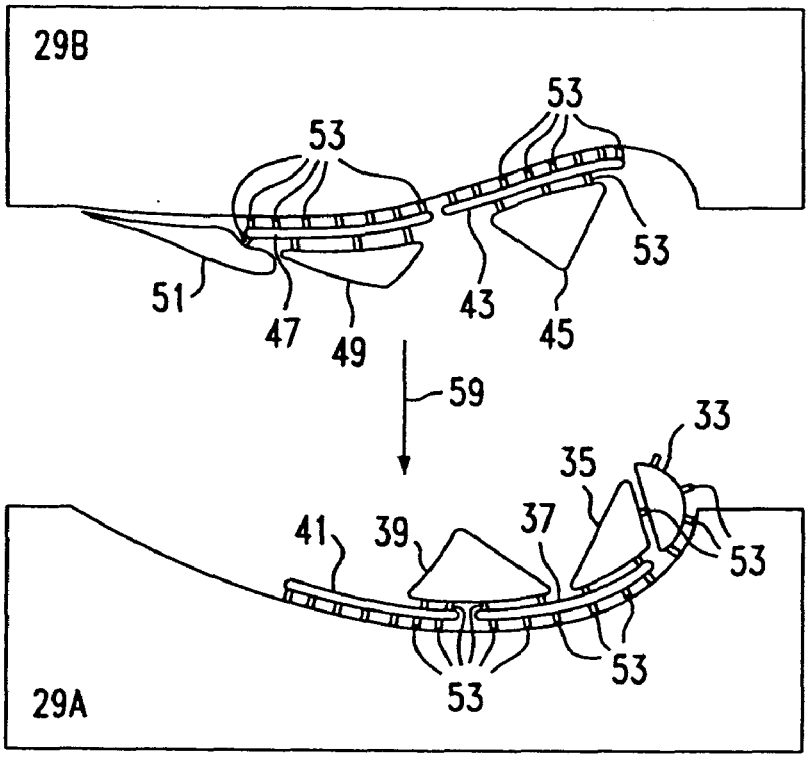
FIG. 3 is a separated casting mold for the hollow body of FIG. 1.
Figure 4:
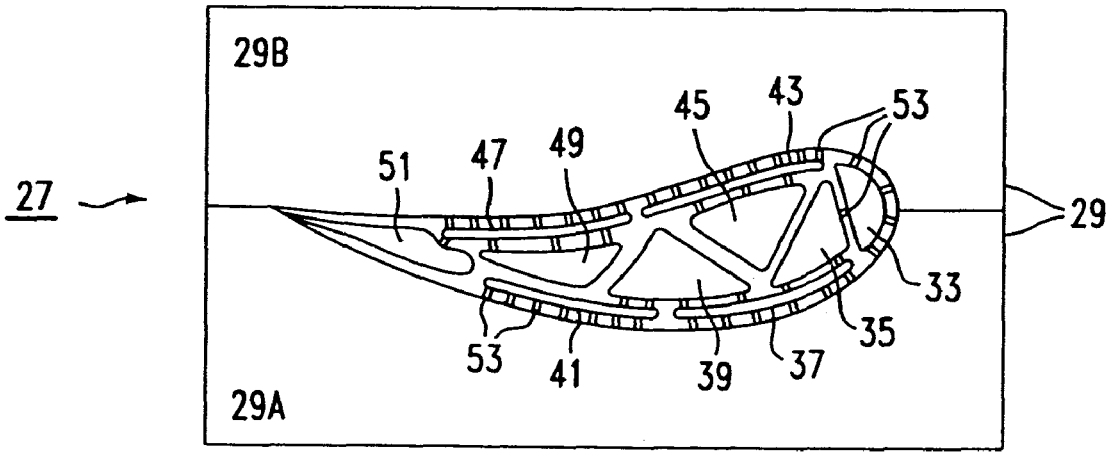
FIG. 4 is an assembled casting mold for the hollow body of FIG. 1.

As can be appreciated by reference to FIGS. 3 and 4, this is achieved in accordance with the invention by means of a device forming a separable casting mold (27) for a metallic hollow body. Said separable casting mold (27) comprises an exterior casting mold (29) which is separable into multiple exterior members (29A, 29B) and at least one inside core (33, 35, 37, 39, 41, 43, 45, 47, 49, 51) with a connecting element (53). The exterior casting mold substantially represents the negative of the outside surface of the hollow body to be cast while the inside core serves to form the hollow hollow space. The inside core is firmly connected via at least one connecting element with at least one exterior member of the exterior casting mold. The connecting elements (53) fixate the inside core (33, 35, 37, 39, 41, 43, 45, 47, 49, 51) with regard to its position relative to the exterior casting mold and form the through-openings through the wall of the component to be cast. Each connecting element is designed such that its dimensions and its position correspond with the dimensions and the position of a through-opening through the wall of the component to be cast into the hollow space formed by the inside core. The number of connecting elements (53) preferably corresponds to the number of the through-openings provided in the component to be cast.

In order to fixate the position of the inside core (33, 35, 37, 39, 41, 43, 45, 47, 49, 51) relative to the exterior casting mold (29) the connecting elements (53) extend from the surface of the inside core to the exterior casting mold and touch the exterior members such that when the casting material is subsequently filled in it is unable to get between the connecting elements and the exterior casting mold or the inside core. This achieves the advantage that the inside core (33, 35, 37, 39, 41, 43, 45, 47, 49, 51) and the exterior casting mold (29) are at a defined distance from each other which corresponds to the wall thickness of the component to be cast. The casting mold for the component to be cast consists of the exterior members (29A, 29B) that are joined to form the exterior casting mold with the inside cores that are connected via connecting elements (33, 35, 37, 39, 41, 43, 45, 47, 49, 51) and the connecting elements (53). Because the casting mold is produced without a wax jacket an undesired change cannot occur in the position of the inside core relative to the exterior casting mold as a result of varying thermal expansion of the inside core, the exterior casting mold and/or the connecting elements when the wax jacket melts.

Advantageously, an inside core is firmly connected via at least one connecting element with an exterior member of the exterior casting mold. This results in the advantage that the inside core will not change its position relative to the exterior casting mold even when the casting mold is filled with liquid metal.

Preferably, an inside core (33, 35, 37, 39, 41, 43, 45, 47, 49, 51) is connected precisely with one exterior member (29). This achieves that the completed casting mold can be assembled from at least two separate components (29A, 29B), while each component consists of precisely one exterior member which may be firmly connected with all inside core (33, 35, 37, 39, 41, 43, 45, 47, 49, 51) via associated connecting elements (53). In addition to the connecting elements (53) used for firmly connecting the inside core (33, 35, 37, 39, 41, 43, 45, 47, 49, 51) and the exterior member (29A, 29B) further connecting elements (53) can be associated with the inside core (33, 35, 37, 39, 41, 43, 45. 47, 49, 51), which elements serve to form additional through-openings (25) as can be appreciated by referenced FIG. 2. In order to be able to withstand the high temperatures and the related high thermal stress on the casting mold when the component is cast the exterior casting mold preferably consists of a ceramic material.

The inside core preferably also consists of a ceramic material.

For hollow bodies in which the shape of the hollow space is particularly complicated (such as a hollow body with one or two narrow passages) multiple inside cores (33, 35, 37, 39, 41, 43, 45, 47, 49, 51) preferably serve to form the hollow space. This allows the geometry of each individual inside core to be produced relatively easily, thereby achieving a cost-effective production of the casting mold.

If the hollow space is intended, for example, as a supply channel for supplying cooling air to a turbine blade the inside core forming the supply channel advantageously extends along a main expansion direction and has a substantially trapezoid or triangular cross-sectional area vertical to the main expansion direction. This results in the advantage that two inside cores serving to form two different supply channels and which are fastened to two different exterior members are able to engage in the manner of a gearing and thus will not impair the joining of the exterior members to form the casting mold.

If the hollow space serves to form a cooling pocket, such as a cooling pocket of a turbine blade, the inside core forming the cooling pocket is preferably substantially plate-shaped. An inside core serving to form a supply channel supplying the cooling pocket with cooling air is then connected via the plate-shaped inside core with the exterior casting mold.

If a component to be cast has multiple hollow spaces, multiple inside cores advantageously serve to form the various hollow spaces. In order to further increase the stability of the casting mold and to prevent that the inside cores serving to form various hollow spaces will shift relative to each other such inside cores are spaced apart via at least one connecting element, particularly via spacer nubs (53).

The device described above is preferably used for manufacturing a metallic hollow body having at least one hollow space and a wall encompassing the hollow space, for manufacturing a turbine blade (1) for a gas turbine where the hollow space is formed as a cooling channel of the turbine blade and multiple cooling air openings are provided for the cooling channel (7, 11, 13, 17), where each cooling air opening is formed by means of a through-opening (25). Using the device offers the advantage that the finished turbine blade has a defined wall thickness and thus the quantity of cooling air required for cooling the turbine blade can be adjusted to the max, permissible surface temperature of the turbine blade. Overall, the cooling air requirement is extremely low resulting in the gas turbine having a high degree of efficiency. A further advantage is achieved in that the turbine blade will not have to be reworked after the casting mold has been removed. Among other things, drilling the cooling air openings and removing the pins projecting above the outside surface is not required as is the case when an inside core of the casting form was fixated in place with metallic pins according to the state of the art. Furthermore, no pins of precious metal (such as platinum) are required for producing the casting mold, which not only decreases the production costs, but it also reduces the risk that localized alloys could develop.

The problem of finding a method is solved in accordance with the invention by means of a method for producing a metallic hollow body having at least one hollow space and a wall encompassing the hollow space, which wall has a through-opening, where a casting mold (29A, 29B) is filled with metal, in that an inside core (33, 35, 37, 39, 41, 43, 45, 47, 49, 51) serving to form a hollow space is connected via at least one connecting element (53) with an exterior member of an exterior casting mold (29A, 29B) which is separated into at least two exterior members, that the exterior members are subsequently joined to form the exterior casting mold, that the casting mold comprising the exterior casting mold, the connecting elements and the inside core is filled with metal and that the casting mold is subsequently removed.

According to this method, the casting mold of a hollow body can be assembled piece by piece. Each component of the casting mold consists of at least one exterior member (29A, 29B) of the exterior casting mold and, if applicable, of one or more associated inside cores (33, 35, 37, 39, 41, 43, 45, 47, 49, 51) which are fastened by means of connecting elements (53) to the exterior members of a component. Each component, in turn, represents a component which may consist of smaller units. This allows the piece by piece assembly of a casting mold for a hollow body having a complicated shape from multiple smaller elements having a relatively simple geometry resulting in the advantage that a high number of prefabricated or partially prefabricated elements (such as connecting elements, inside cores) can be used for building the components of the casting mold which reduces the structural efforts, and thus the production costs. The exterior members of the prefabricated components arc subsequently assembled and firmly connected with each other to form the casting mold for the hollow body. Then, the finished casting mold is filled as usual with molten metal and removed after the metal has solidified.

Figure 1:
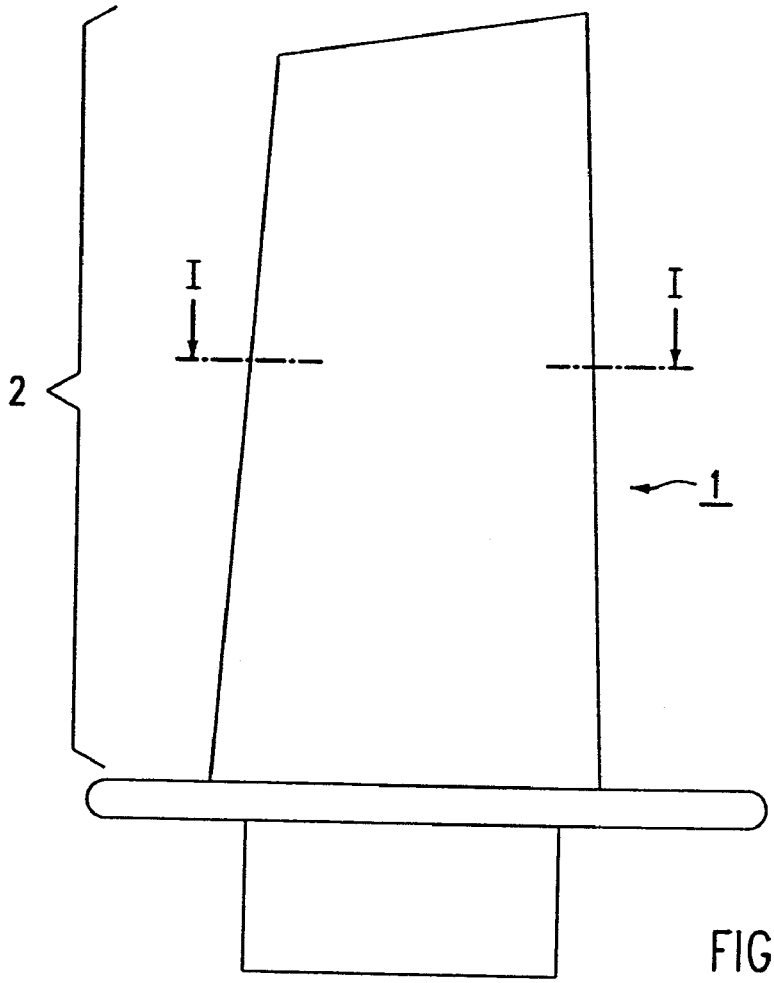
FIG. 1 is a side view of a hollow body.
Figure 2:
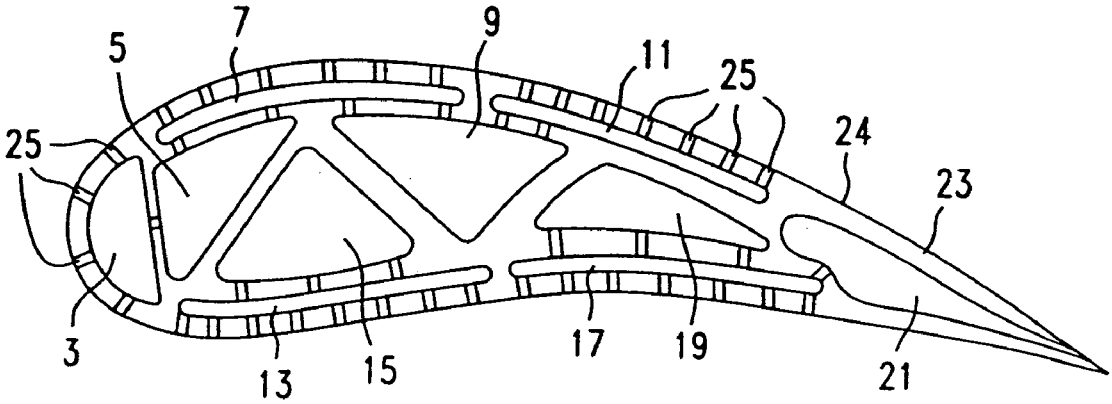
FIG. 2 is the cross-section of the hollow body of FIG. 1 along line I—I.

FIG. 1 shows a hollow body 1 by means of a side view of a turbine blade having a blade area 2 for a gas turbine. The turbine blade 1 has a number of hollow spaces 3, 5, 7, 9, 11, 13, 15, 17, 19 and 21 encompassed by a wall 23, as shown in FIG. 2 in the profile through the blade area 2 along line I—I. The hollow spaces 3, 5, 7, 9, 11, 13, 15, 17, 19 and 21 form cooling channels 3, 5, 9, 15, 19 and 21 and cooling air pockets 7, 11, 13 and 17 which can be acted upon by cooling air. The wall 23 of the turbine blade 1 has a number of through-openings 25, also referred to as cooling air openings 25, leading into the cooling air pockets 7, 11, 13 and 17 and the cooling channel 3. The cooling air can exit from the cooling channels within the turbine blade 1 through said cooling air openings 25 to the outside surface 24 of the wall 23 where it forms a cooling air film.

FIG. 3 shows a device for manufacturing a turbine blade 1. The device consists of a ceramic casting mold 27 comprising an exterior casting mold 29 which is separated into two exterior members 29A and 29B. The casting mold 29 is formed by moving the exterior member 29B in the direction 59 to mate with exterior member 29A. The casting mold 27 also comprises a number of ceramic inside cores 33, 35, 37, 39, 41, 43,145, 47, 49 and 51 serving to form the hollow spaces 3, 5, 9, 15, 19, 21. The inside cores 33, 37, 41 are connected via ceramic connecting elements 53 with the exterior member 29A and the inside cores 43, 47 and 51 are connected accordingly with the exterior member 29B. The inside cores 35 and 39 are also connected and spaced apart via connecting elements 53 (spacer nubs) with the adjacent inside cores 33 and 37 and 37 and 41, while the remaining inside cores 45 and 49 are fastened only to one additional inside core 43 or 47, respectively, via connecting elements 53. The various inside cores 33 to 51 have varying shapes in accordance with the function of the hollow spaces they are forming. The cooling air pockets 7, 11, 13 and 17, for example, are formed by plate-shaped inside cores 37, 41, 43 and 47. The plate-shaped inside cores have holes 67 (see FIG. 5) serving to form bridges (not shown) in the cooling pockets 7, 11, 13 and 17. Said bridges reinforce the mechanical stability of the turbine blade 1 in the area of the wall 23. Connecting elements 53 are glued to the plate-shaped inside cores 37, 41, 43 and 47, which elements, in turn, are glued to one of the exterior members 29A or 29B. The ceramic connecting elements 53 correspond in dimension and position with the cooling air openings 25 they are forming in the turbine blade 1 and thus preferably have a cylindrical cross-section.

FIG. 4 shows the cross-section of the casting mold 27 assembled from the exterior members 29A and 29B and the inside cores 33, 35, 37, 39, 41, 43, 45, 47, 49 and 51 and the connecting elements 53. The exterior members 29A and 29B are firmly connected in this case. In the area of the center of the casting mold 27 the inside cores 35, 39, 45 and 49 engage in the manner of a gearing and thus allow the exterior members 29A and 29B to be joined easily. As a result of the firm connection of each inside core with one of the two exterior members 29A or 29B the position of each inside core relative to the adjacent inside cores and relative to the exterior casting mold formed by the exterior members 29A and 29B is clearly defined.

Figure 5:
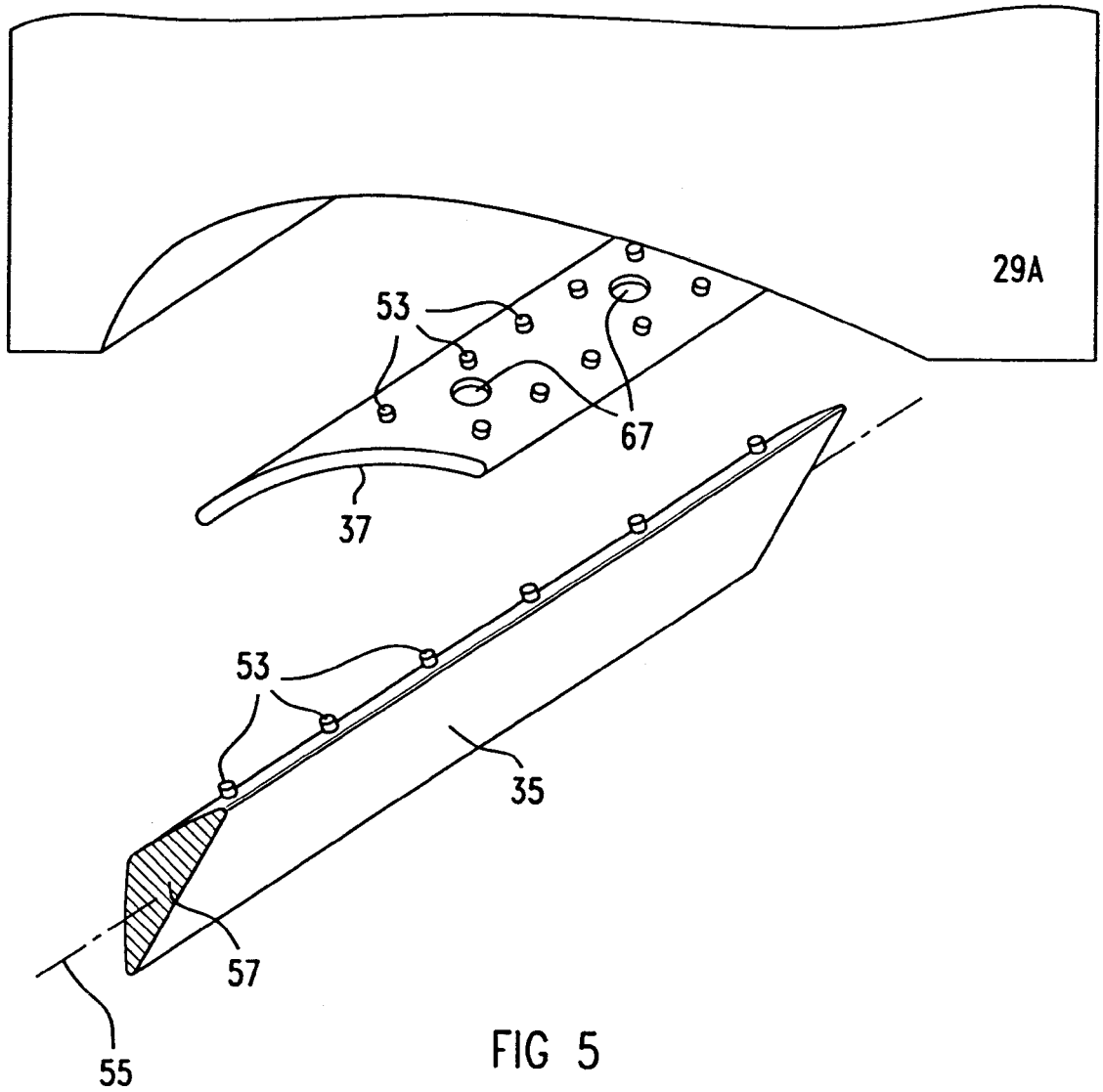
FIG. 5 is a perspective view of a section of FIG. 3.

FIG. 5 shows a perspective view of a section of FIG. 3 where, for better illustration, the inside cores 37 and 35 have not yet been connected with the exterior member 29A or with the inside core 37.

The place-shaped inside core 37 serves to form the cooling pocket 7 which is supplied with cooling air by the cooling air channel 5. The inside core 35 serving to form the cooling air channel 5 extends along a main extension direction 55. The cross-sectional area 57 perpendicular to the main extension direction 55 of the inside core 35 has a substantially triangular shape. The connecting elements 53 form cooling air openings 25 or connections from the cooling channel 35 to the cooling pocket 37, and they also maintain a fixed distance between the inside cores 37 and 35 or between the inside core 37 and the exterior member 29A.

The casting mold 27 for the turbine blade 1 is assembled in multiple stages. Because the connecting elements 53 have a cylindrical cross-section they can be cut to the required length from a rod-shaped preliminary material and glued, for example, to the inside cores 33, 37, 41, 43 and 47, in the positions of the cooling air openings 25. Then, the plate-shaped inside cores 37 and 41, or 43 and 47 occupied by the connecting elements 53 and the inside cores 33 or 51, respectively, are firmly glued to the exterior halves 29A and 29B via the correcting elements 53. Subsequently, the inside cores 35, 39, 45 and 49 forming cooling air channels for supplying the cooling air pockets 7, 11, 13 and 17 with cooling air are glued together with their associated inside cores 37, 41, 43 and 47 via connecting elements 53 (spacer nubs). The exterior members 29A and 29B are then joined and firmly connected to form the casting mold 27. In order to form the turbine blade 1 the casting mold 27 is filled with molten metal. When the metal has solidified the casting mold 27 is removed, for example by reaching out, and it then releases the finished turbine blade 1.

What is claimed is:

1. A device for manufacturing a metallic hollow body having at least one hollow space and a wall encompassing the hollow space, comprising an exterior casting mold which has a number of inside cores serving to form hollow spaces, characterized in that the exterior casting mold is separable into at least two exterior members and that the inside cores are respectively connected via at least one connecting element, which serves to form a through-opening in the wall into the hollow space, precisely with one exterior member of the exterior casting mold.

2. The device according to claim 1, characterized in that the inside core is firmly connected via at least one connecting element with an exterior member of the exterior casting mold.

3. The device according to claim 1, characterized in that the exterior casting mold consists of a ceramic material.

4. The device according to claim 1, characterized in that the inside core consists of a ceramic material.

5. The device according to claim 1, characterized in that multiple inside cores serve to form the hollow space.

6. The device according to claim 1, characterized in that the connecting element is cylindrical.

7. The device according to claim 1, characterized in that multiple inside cores are provided for forming at least two hollow spaces.

8. The device according to claim 7, characterized in that at least two inside cores serving to form various hollow spaces are connected and spaced apart via another connecting element and each of said cores is connected either directly through at least one connecting element or indirectly, through the another connecting element precisely with one exterior member of the exterior casting mold.

9. The device according to claim 1, characterized in that an inside core serving to form a supply channel for cooling air extends along a main expansion direction and has a substantially trapezoid or triangular cross-sectional area perpendicular to the main expansion direction.

10. The device according to claim 1, characterized in that a substantially plate-shaped inside core serving to form a cooling pocket is connected both with the one exterior member of the exterior casting mold and with a second inside core serving to form a supply channel that supplies the cooling pocket with cooling air.

11. A device for manufacturing a metallic hollow body having at least one hollow space and a wall encompassing the hollow space, comprising an exterior casting mold which has at least one inside core serving to form the hollow space, the exterior casting mold being separable into at least two exterior members and the inside core is connected via at least one connecting element, which serves to form a through-opening in the wall into the hollow space, with an exterior member of the exterior casting mold, characterized in that the connecting element consists of a different material than the inside core and/or the exterior casting mold.

12. A device for manufacturing a metallic hollow body having at least one hollow space and a wall encompassing the hollow space, comprising an exterior casting mold which has a number of inside cores serving to form hollow spaces, where the exterior casting mold is separable into at least two exterior members and the inside core is connected via at least one connecting element, which serves to form a through-opening in the wall into the hollow space, with only one exterior member of the exterior casting mold, for manufacturing a turbine blade of a gas turbine, where the hollow space is formed as a cooling channel and multiple cooling air openings are provided for the cooling channel where each cooling air opening is formed by means of a through-opening through the wall.

13. A method for manufacturing a metallic hollow body having at least one hollow space and a wall encompassing the hollow space, the wall having a through-opening, where a casting mold is filled with metal characterized in that a) fastening a number of inside cores serving to form hollow spaces respectively via at least one connecting element to only one exterior member of an exterior casting mold which is separated into at least two exterior members, b) joining the exterior members to form the exterior casting mold, c) filling the casting mold comprising the exterior casting mold, the connecting elements and the inside core with metal, and d) removing the casting mold.

* * * * *